US006126554A

United States Patent [19]

Poscente

[11] Patent Number: 6,126,554

[45] Date of Patent: Oct. 3, 2000

[54] SWING TRAINING DEVICE

[75] Inventor: Terry Poscente, Calgary, Canada

[73] Assignee: Swing Jacket International Corporation, St. Michael, St. Kitts/Nevis

[21] Appl. No.: 09/207,976

[22] Filed: Dec. 1, 1998

[30] Foreign Application Priority Data

Oct. 23, 1998 [CA] Canada ..... 2251127

[51] Int. Cl.[7] ..... A63B 69/36

[52] U.S. Cl. ..... 473/212; 473/215

[58] Field of Search ..... 473/212, 207, 473/215, 458, 276, 277

[56] References Cited

U.S. PATENT DOCUMENTS

| | | | |
|---|---|---|---|
| 1,699,219 | 1/1929 | Bemish et al. | 473/212 |
| 2,773,691 | 12/1956 | Redfield . | |
| 3,595,583 | 7/1971 | Oppenheimer . | |
| 4,239,228 | 12/1980 | Norman et al. . | |
| 4,960,280 | 10/1990 | Corder, Jr. . | |
| 5,188,365 | 2/1993 | Picard . | |
| 5,397,122 | 3/1995 | Herridge, II . | |
| 5,435,563 | 7/1995 | Salvatore . | |
| 5,441,271 | 8/1995 | Briggs . | |
| 5,529,306 | 6/1996 | Stadts et al. . | |
| 5,658,203 | 8/1997 | Shub . | |
| 5,665,015 | 9/1997 | Clark, III . | |

OTHER PUBLICATIONS

Portion of U.S. Patent 5,451,060 dated Sep. 19, 1995.

Cover Sheet of U.S. Patent 3,900,199 dated Aug. 19, 1975 McGonagle.

*Primary Examiner*—Jeanette Chapman
*Assistant Examiner*—Stephen L. Blau
*Attorney, Agent, or Firm*—Bennett Jones

[57] ABSTRACT

A swing training device is described which constrains both arms of an individual to follow a predetermined swing path. The device includes a member for securing about the torso of an individual and arm bands for securing about the arms of the individual. The arm bands are mounted on guide rails mounted on the torso member through connectors which permit the arm bands to slide along the length of the rails. The arm rails are formed of a rigid material which is resistant to bending out of position. Thus, restraining the arm bands to move along a preferred swing path established by the rails. In addition, the member for securing around the torso and the arm bands are constructed to prevent the device from riding up over the torso and arms of an individual into an ineffective position in the armpits of the individual.

28 Claims, 3 Drawing Sheets

SWING TRAINING DEVICE

FIELD OF THE INVENTION

This invention is directed to a swing training device for sports and, in particular, a device for improving the fundamentals of an individual's swing for a particular sport.

BACKGROUND OF THE INVENTION

Golf is a popular recreational activity for persons of all ages and levels of skill. The objective of propelling the golf ball along a desired line of flight is best achieved by having the club head square to the target and moving along a path toward the target at the instant of impact with the ball. This is consistently achieved with a golf swing where arm, torso and leg movement is properly coordinated.

Golfers invest millions of dollars annually into hiring teaching professionals to teach them proper golf fundamentals. The challenge these students face is that while their minds are focused on the specific instructions of the teaching professional they are not able focus their attention on the 'feel' of a proper golf swing path. As a result golfers revert to their habitual golf swing soon after their lesson is over.

A variety of methods have been devised to aid a golfer to develop a proper, more accurate and consistent golf swing. In many methods, efforts are made to control the player's arms or hands. Other devices attempt to control the path of the club by means of a fixed or rotating device in which movement of the club is guided along a preset path.

None of the prior art devices attempt to control the swing plane of both arms of the golfer and, thus, they do not address the real problem which causes an ineffective and/or inconsistent golf swing.

SUMMARY OF THE INVENTION

A swing practice device has been invented which guides the arms of an individual to follow a proper swing plane. In addition, the swing practice device links an individual's arms to their torso and, thereby, encourages proper torso rotation and weight transfer. The purpose of the invention is to allow the individual to focus on nothing but the 'feel' of a proper swing by guiding their arms through a swing path that will impart solid impact with the ball. As the muscle memory for a proper swing is developed, the individual's swing quite naturally improves along with the ability to repeat it consistently.

In accordance with a broad aspect of the present invention, there is provided a swing training device comprising a torso fitting member, a leading arm rail, a trailing arm rail, each of the leading arm rail and the trailing arm rail being secured to the torso fitting member, a leading arm band being mounted on and slidably moveable along the leading arm rail, and a trailing arm band being mounted on and slidably moveable along the trailing arm rail.

The swing training device is intended to be worn by an individual training to play golf and requiring proper arm movement. The arm bands are worn about the arms of the individual and the torso fitting member is secured about the torso of the individual. When wearing the swing training device, both of the individual's arms will be constrained to move through a proper swing path.

A guide rail is provided for each of the leading arm and the trailing arm. The rails are elongate members and each rail extends along a path selected to permit movement of the arm bands to constrain arm movement to a proper swing path. Generally, the proper swing path for an individual begins at take away to a top position and from the top position the proper swing is a consistent path down through impact with the ball and up to a follow-through position. Generally, therefore, the leading arm rail is positioned on the torso fitting member such that it extends from a position proximate the individual's sternum to a position below the arm of individual. The trailing arm rail, generally, extends from a position under the arm of the individual to a position proximate the individual's sternum. The rails can be positioned on the torso fitting member in accordance with a predetermined average swing path for example, as determined by studying the golf swings of expert golfers. Alternatively, a swing training device can be custom produced for an individual by studying the individual's swing and then positioning the rails on the torso fitting member in accordance with the swing information obtained from the study.

The rails are preferably formed of a durable, substantially stiff material, such as stiff plastic, for example nylon, or metal, that substantially will not bend out of position during use.

An arm band is connected to each guide rail for securing the arm of an individual to the guide rail. Preferably, the arm band is formed to secure about an individual's arm between the biceps and the elbow. The arm bands can be formed of any suitable material in any suitable configuration for securing about the arm. In one embodiment, each arm band is formed of polymeric fabric strip having a releasable connecting means at each end for connecting the band about the arm. To facilitate use of the device, the releasable connecting means is preferably actuatable by one hand such as, for example, a snap fastener or fabric fasteners such as, for example Velcro™. In one embodiment, the arm band is formed so that the ends thereof remain loosely attached when the arm band is undone. This provides simplified attachment of the arm band since the arm can be inserted through the band (i.e. in a manner similar to donning a short sleeved shirt). The arm band is then tightened, using one hand, about the arm of the individual.

Each arm band is connected to its rail to ride therealong and to follow the path defined by the rail. The arm band can be slidably connected to the rail in any suitable way. In one embodiment, the arm band is connected directly to the rail. In another embodiment, a glider is connected between the arm band and the rail. The glider is stitched to the arm band or connected thereto in any other suitable way. The glider and the rail can be selected to cooperate in any suitable way to permit the glider to ride along at least a length of the rail. In one embodiment, the glider has one or more protrusions which are engaged in one or more channels formed on the rail. In another embodiment, the glider is formed as a loop or ring which fits over the rail. The gliders and/or rails can be fit with means such as, for example, low friction polymeric material, ball bearings or rollers to facilitate movement of the gliders along the rails.

The torso fitting member retains the rails and maintains them in a proper position about an individual. The torso fitting member is formed of a relatively stiff material so that it secures the rails against being pulled out of position and acts to transmit forces exerted through the arm bands and the rails into the member and thereby to the torso of the individual. This force transfer will assist in training and in proper weight transfer and torso rotation. In one embodiment, the torso fitting member is formed of, for example, metal, plastic or a combination thereof. The stiff materials can be covered or decorated in any desired way to improve the feel or look of the device. As an example, a durable foam and/or durable fabric coating can be secured over the member. The torso fitting member can be formed in any suitable way for securing about the torso of an individual generally above the waist and below the arms. In one embodiment, the torso fitting member is a belt having a suitable width to accommodate the rails. In another embodiment, the torso fitting member is a pair of spaced apart belts connected by a spacer band. One end of each rail is connected by suitable fasteners to one of the belts and the opposite end of each rail is connected by suitable fasteners to the other belt or to the spacer band.

The torso fitting member can be secured about the individual in any suitable way. In one embodiment, the torso fitting member is an elongate member and includes buckles, zippers or Velcro at its ends to allow the individual to securely fasten the device about the torso.

The rails can be secured to the torso fitting member in any suitable way with consideration as to the mechanism used to permit movement of the arm bands along the rails. In one embodiment, the rails are secured against the torso fitting member. In another embodiment, the rails are mounted such that they are spaced from the surface of the torso fitting member. The rails can be substantially uniformly spaced from the surface of the torso fitting member or can extend out greater distances from the torso fitting member to provide a greater range of motion at selected areas along the rail. In one embodiment, the rails are firmly secured to the torso fitting member by releasable fasteners. This permits readjustment of the positioning of the rails to allow for practising different types of shots or to achieve a different effect. Locks can be mounted on the rails to limit the length of the swing, where desired. Thus, in accordance with one aspect of the invention, the swing training device is adjustable in various ways to guide a golfer through proper chipping/pitching swings or putting strokes. The device is also useful for guiding the golfer through selected muscle memory exercises.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figure 1:
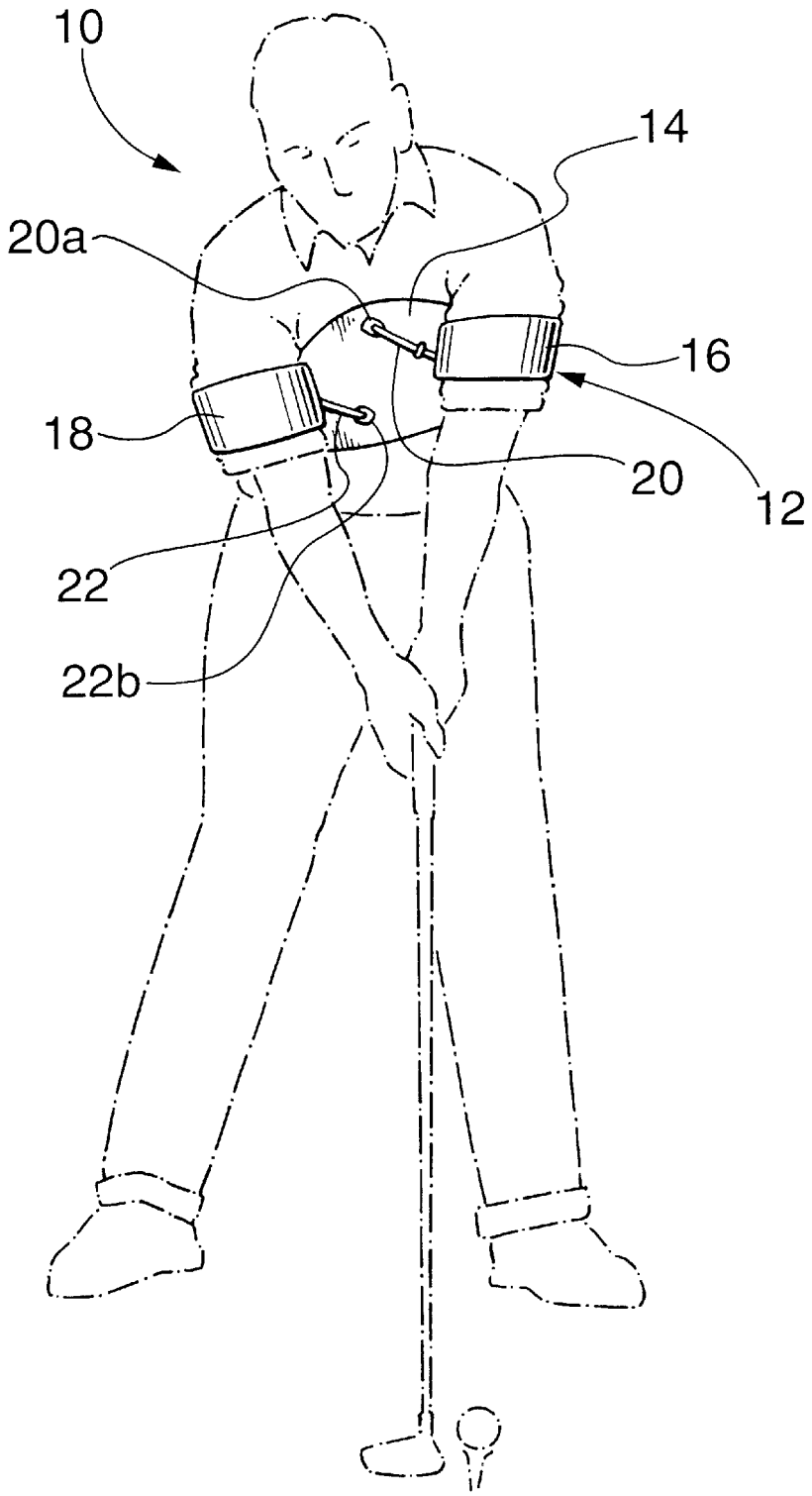
FIG. 1 is a perspective view of a golfer wearing a swing training device according to the present invention.

Referring to FIG. 1, a trainee individual 10 is shown wearing a swing training device 12 according to the present invention. The swing training device includes a torso fitting member 14 formed as a belt and able to be fit about the individual's chest, a leading arm band 16 and a trailing arm band 18. Arm band 16 is connected to ride along a leading arm rail 20, while trailing arm band 18 is connected to ride along a trailing arm rail 22.

When wearing device 12 during a golf swing, the individuals arms will be constrained to follow a path defined by the arm bands riding along the arm rails 20, 22. The arm rails are positioned on the torso fitting member to define the proper swing path for the individual. Individual 10 is a right handed golfer and, thus, when torso fitting member 14 is properly positioned around the individual's torso, leading arm rail 20 extends between a first end 20*a* positioned proximate the individual's sternum and a second end (not shown) positioned below the individual's arm pit of the leading arm. In one embodiment, the rail is curved down from first end 20*a* and curves back upwardly toward the second end. Trailing arm rail 22 extends between a first end (not shown) positioned below the arm pit of the individual's trailing arm and a second end 22*b* positioned proximate the individual's sternum. Trailing arm rail 22 can be curved between its ends. While a device suited for a right hand golfer is shown, a device for left hand golfers can be provided by repositioning the rails.

The swing training device also acts to maintain the individual's arms close to his/her body. The individual's arms can be raised away from the body a distance as limited by the arm band connection to the arm rail. This tends to keep the individual's arms an appropriate distance from their body to affect a proper swing and also tends to encourage torso rotation and weight transfer.

Figure 2:
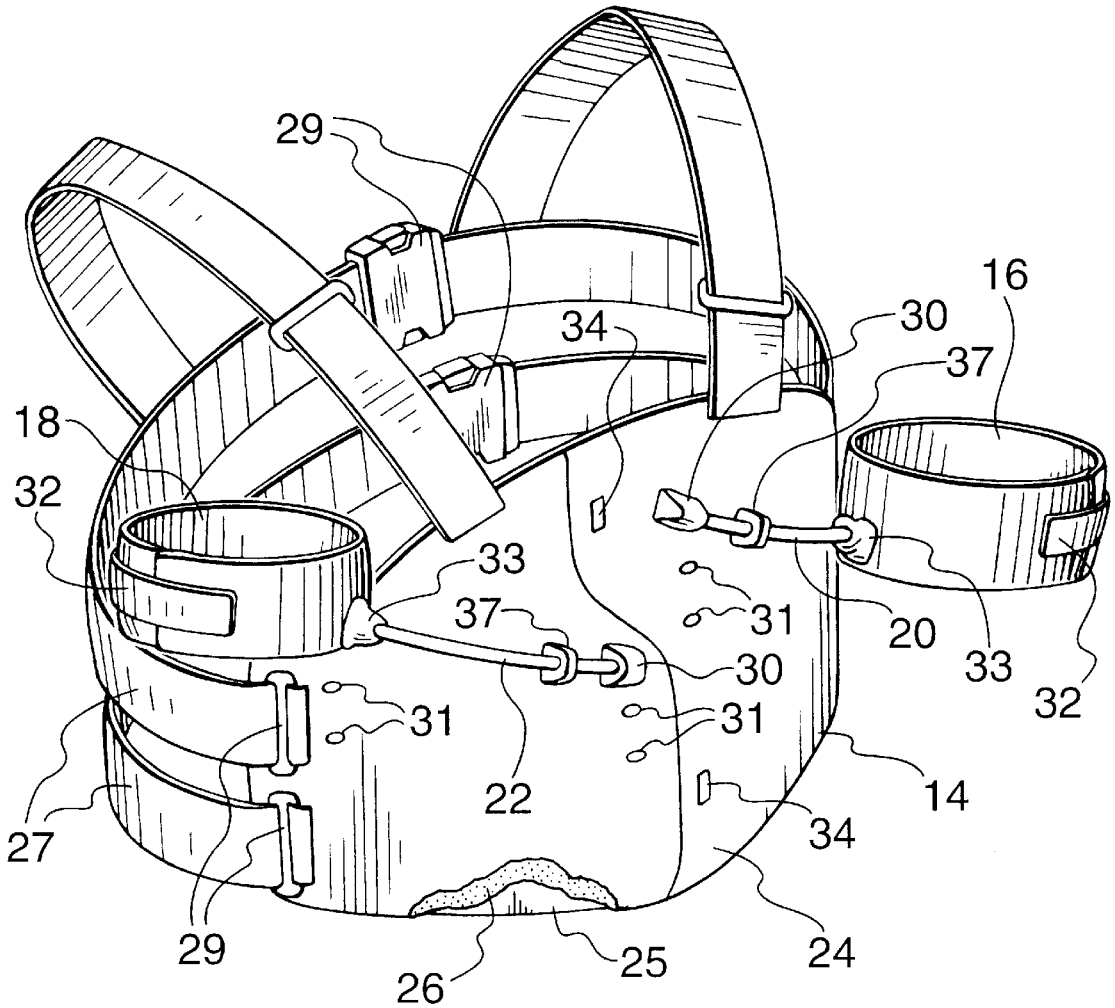
FIG. 2 is a perspective view of a swing training device according to the present invention.

Referring now to FIG. 2 one embodiment of a swing training device is shown. Torso fitting member 14 includes a wide front member 24 formed to have some flexibility along its length but little flexibility along its width. It must be stiff enough to absorb the forces that will be placed upon it, for example at the rails, while being flexible enough to be comfortable for the individual when worn. In one embodiment, front member 24 is formed of stiff plastic 25 and is covered in durable fabric 26 such as, for example, cordura nylon. Preferably, the fabric on the inner facing side of at least a portion of the torso fitting member, for example inner facing side 24' of the front member 24, is textured or treated in some way to frictionally engage an individuals clothes and, thereby, to substantially prevent the torso fitting member from sliding out of position when worn. Front member 24 fits across the chest and under the arms of the individual. Belts 27 with buckle members 29 are secured at the ends of front member 24 to provide an adjustable means for securing the device about the individual. Buckles 29 can be replaced with other suitable connecting means, as noted previously.

The front member is of a width to secure the ends of rails 20, 22. In particular, rails 20, 22 are secured to torso fitting member 14 by connectors 30 extending through holes formed through front member 24 (The holes cannot be seen as they are disposed behind the rails). Connectors 30 are preferably releasable threaded-stem or snap-type metal or plastic rivets. However, other kinds of connectors can be used as desired. Further holes 31 are formed through front member 24 to permit adjustment in the position of the rails.

Leading arm band 16 and trailing arm band 18 are each preferably formed of fabric. In one embodiment, plastic or metal inserts are inserted into the arm bands to stiffen and/or reinforce them against the forces exerted during use. Arm bands 16, 18 have corresponding fasteners 32 at their ends to permit securing about the arms of the individual. Any suitable fasteners 32 can be used, for example, Velcro or snaps. Leading arm band 16 is attached to rail 20 and trailing arm band 18 is attached to rail 22 by loops 33. Loops 33 are attached by fasteners (not shown) to arm bands. Loops 33 are engaged about rails 20, 22 and are free to slide thereallong between connectors 30. The loops can include rollers or other friction reducing means, to facilitate their movement along the rails.

Figure 3:
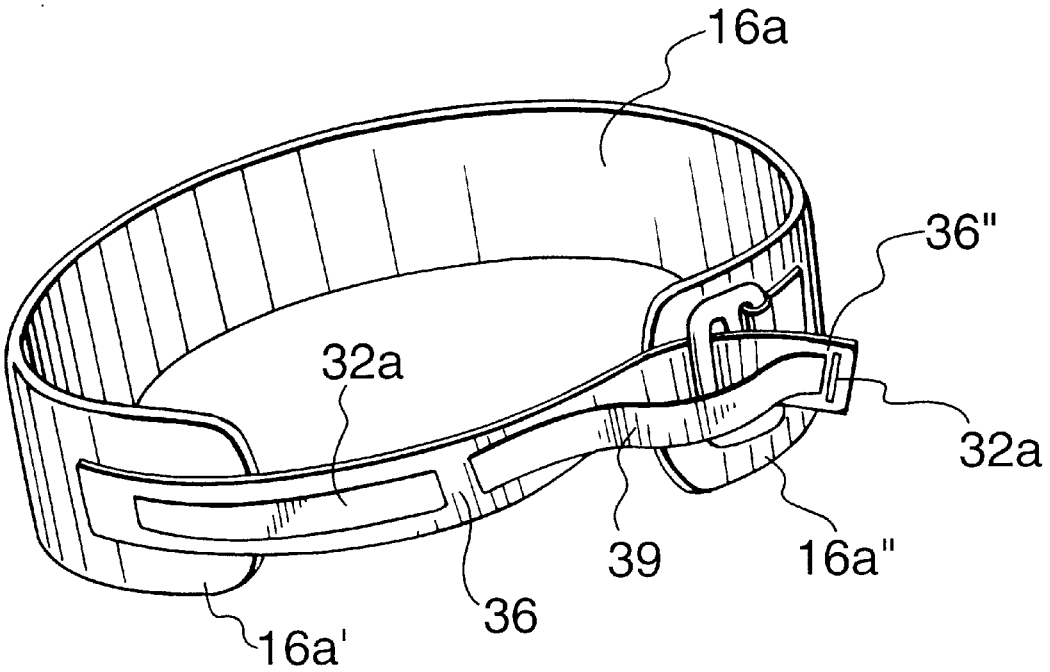
FIG. 3 is a perspective view of an arm band useful in the present invention; and, FIG. 4 is a perspective view of another arm band useful in the present invention.
Figure 4:
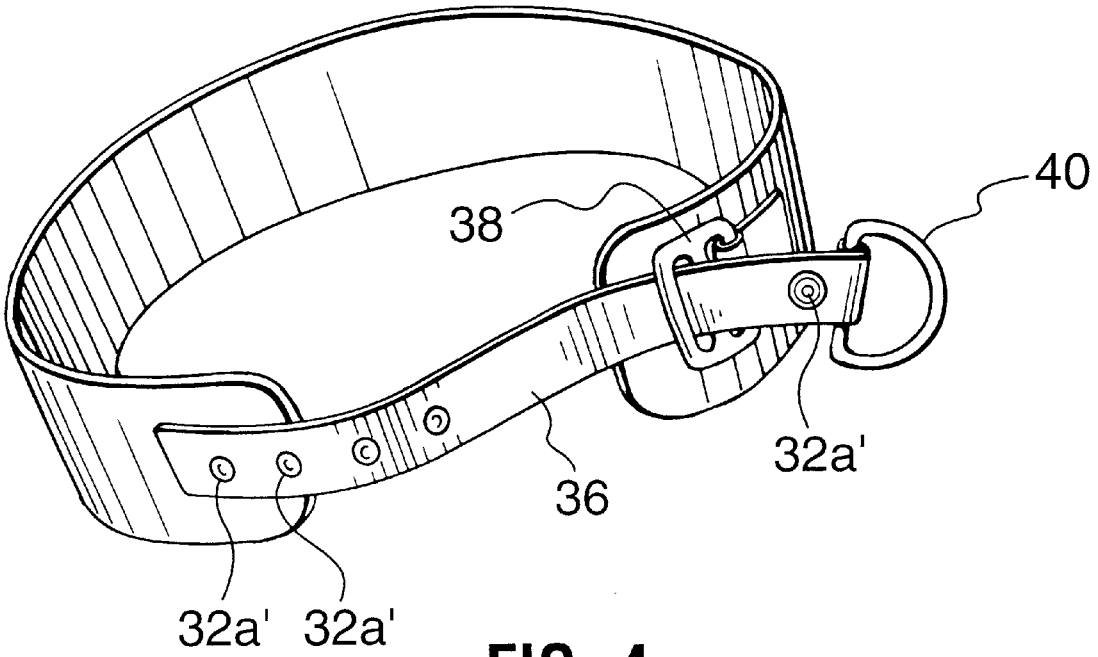

Referring to FIGS. 3 and 4, two further embodiments of arm bands useful with the present invention are shown. Each of these arm bands are easy to use since their ends remain connected even when the arm band is undone. These arm bands can be secured in position using one hand. This facilitates use of the golf swing training device by an individual without requiring assistance. In FIG. 3, an arm band 16*a* is shown having ends 16*a*', 16*a*". A strap 36 extends between ends 16*a*', 16*a*" and, in particular, one end of strap 36 is attached, as by stitching to end 16*a*' while an opposite end 36" of the strap is inserted through a loop 38 on end 16*a*". A second strap 39 is attached at its ends to strap 36 on either side of loop 38 but does not extend through loop 38. Second strap 39 acts to end 36" from falling out of loop 38. The arm band 16*a* can, therefore, be secured about a golfer's arm by insertion of the arm through the central opening of the arm band and, when in proper position, pulling end 36" through loop 38 until fasteners 32*a* align.

The arm band of FIG. 4 is similar to the arm band of FIG. 3 except that a ring 40 is attached at end 36" of strap 36 to prevent the end from passing out of loop 38. Additionally, for exemplary purposes only, snap type fasteners 32*a*' are shown.

Referring back to FIG. 2, to broaden the application of the swing training device, locks 37 are provided for mounting on rails 20, 22. Locks 37, which may be, for example, a lock nut or the like, are positionable on the rails at any point to limit the range of movement of the arm bands along the rails. The locks can be secured about the rail to limit the range of the swing to allow a golfer to focus on a selected portion of the swing. As an example, locks 37 can be positioned on the rails to limit the back swing to allow the golfer to focus on muscle memory through the impact zone. As the golfer improves, the locks can be moved to allow the swing to be lengthened.

A torso fitting member can be produced for general use by observing the swing plane of a model individual, such as one or more expert golfers, and positioning the rails in accordance with the standard swing plane which is observed. In a custom device for a particular individual, the proper swing plane for the individual is first determined and this information is used to select the proper position for the rails on the torso fitting member. To prepare a swing training device for general use, a person having a good swing plane can be studied to plot the path travelled by the arms during the swing relative to the chest. This plot of travel can be used to determine the appropriate positioning of the rails on the torso fitting member. The plot can be made manually or by computer modelling. If a custom swing training device is desired for a particular individual, that individual's swing can be studied to determine the best swing plane and, thereby, the best position for the rails. The rails can then be permanently mounted in this determined position on the torso fitting member or can be releasably mounted in the best available position as permitted by the positioning of connectors through any selected holes, such as those identified as 31.

It will be apparent that many other changes may be made to the illustrative embodiments, while falling within the scope of the invention and it is intended that all such changes be covered by the claims appended hereto.

The embodiments of the invention in which an exclusive property or privilege is claimed are defined as follows:

1. A swing training device comprising:

a torso fitting member, a leading arm rail formed of a substantially stiff material and a trailing arm rail formed of a substantially stiff material, each of the leading arm rail and the trailing arm rail being secured to the torso fitting member and each having a first end mounted adjacent an upper edge of the torso fitting member, the leading arm rail extending from its first end and being curved away from the upper edge and away from the first end of the trailing arm rail and the trailing arm rail extending from its first end and being curved away from the upper edge and away from the first end of the leading arm rail, a leading arm band being mounted on and slidably moveable along the leading arm rail, and a trailing arm band being mounted on and slidably moveable along the trailing arm rail.

2. The swing training device of claim 1 wherein each arm has connected thereto a glider, the glider being slidably engaged to the corresponding rail for the arm band.

3. The swing training device of claim 1 wherein the glider includes means to facilitate movement of the gliders along the rails.

4. The swing training device of claim 1 wherein the torso fitting member includes an inwardly facing side and an outwardly facing side, the inwardly facing side including friction enhancing means to increase frictional engagement of the inwardly facing side against a surface.

5. The swing training device of claim 1 wherein the rails are secured to the torso fitting member by releasable connections permitting readjustment of the rails on the member.

6. The swing training device of claim 1 further comprising a lock positionable on at least a selected one of the leading arm rail or the trailing arm rail to provide a limited range of movement of the arm band along the selected arm rail.

7. A method for golf swing training for a trainee individual comprising;

providing a swing training device comprising a torso fitting member, a leading arm rail formed of a substantially stiff material and a trailing arm rail formed of a substantially stiff material, each of the leading arm rail and the trailing arm rail being secured to the torso fitting member and each having a first end mounted adjacent an upper edge of the torso fitting member, the leading arm rail extending from its first end and being curved away from the upper edge and away from the first end of the trailing arm rail and the trailing arm rail extending from its first end and being curved away from the upper edge and away from the first end of the leading arm rail, a leading arm band attached to and slidably moveable along the leading arm rail, and a trailing arm band attached to and slidably moveable along the trailing arm rail;

securing the torso fitting member about the trainee individual's torso;

securing the leading arm band about the trainee individual's leading arm;

securing the trailing arm band about the trainee individual's trailing arm; and permitting the trainee individual to perform a golf swing.

8. The method for golf swing training as in claim 7 wherein a lock is positioned on at least a selected one of the leading arm rail or the trailing arm rail to limit the range of movement of the trainee individual's arm which is connected to the selected rail.

9. The method for golf swing training as in claim 7 wherein at least a selected one of the leading arm rail or the trailing arm rail is repositioned on the torso fitting member.

10. A swing training device comprising:

a torso fitting member including an inwardly facing side and an outwardly facing side, the inwardly facing side including a friction enhancing material to increase frictional engagement of the inwardly facing side against a surface;

a leading arm rail and a trailing arm rail, each of the leading arm rail and the trailing arm rail being formed of a substantially stiff material and secured to the torso fitting member, a leading arm band attached to and slidably moveable along the leading arm rail, and a trailing arm band attached to and slidably moveable along the trailing arm rail.

11. The swing training device of claim 10 further comprising a material disposed between the inwardly facing side and the outwardly facing side, the material selected to be stiff to resist bending between an upper edge and a lower edge of the torso fitting member.

12. The swing training device of claim 10 wherein the friction enhancing material is textured to frictionally engage clothing.

13. The swing training device of claim 10 wherein the friction enhancing material is treated to frictionally engage clothing.

14. The swing training device of claim 10 wherein the arm bands include inserts of stiff material to resist bending between the upper and lower edges thereof.

15. A method for golf swing training for a trainee individual comprising;

providing a swing training device comprising a torso fitting member including an inwardly facing side and an outwardly facing side, the inwardly facing side including a friction enhancing material to increase frictional engagement of the inwardly facing side against a surface, a leading arm rail and a trailing arm rail, each of the leading arm rail and the trailing arm rail being formed of a substantially stiff material and secured to the torso fitting member, a leading arm band attached to and slidably moveable along the leading arm rail, and a trailing arm band attached to and slidably moveable along the trailing arm rail;

securing the torso fitting member about the trainee individual's torso;

securing the leading arm band about the trainee individual's leading arm;

securing the trailing arm band about the trainee individual's trailing arm; and permitting the trainee individual to perform a golf swing.

16. The method for golf swing training as in claim 15 wherein a lock is positioned on at least a selected one of the leading arm rail or the trailing arm rail to limit the range of movement of the trainee individual's arm which is connected to the selected rail.

17. The method for golf swing training as in claim 15 wherein at least a selected one of the leading arm rail or the trailing arm rail is repositioned on the torso fitting member.

18. A swing training device comprising:

a torso fitting member, a leading arm rail and a trailing arm rail, each of the leading arm rail and the trailing arm rail being formed of a substantially stiff material and secured to the torso fitting member, a leading arm band attached to and slidably moveable along the leading arm rail, and a trailing arm band attached to and slidably moveable along the trailing arm rail, the leading arm band and the trailing arm band each being formed of a strip of flexible material including upper and lower edges and ends, the leading arm band and the trailing arm band each having a releasable connector at their ends, the releasable connector having a closed configuration where the ends of the bands are secured to form a circle and an open configuration and a device for maintaining the ends of each arm band attached when the releasable connector is in the open position.

19. The swing training device of claim 18 wherein the releasable connector is a buckle.

20. The swing training device of claim 18 wherein the releasable connector includes Velcro.

21. The swing training device of claim 18 wherein the device for maintaining the ends of each arm band attached is a strap extending between the ends.

22. The swing training device of claim 18 wherein the leading arm band and the trailing arm band include inserts of stiff material to resist bending of the leading arm band and the trailing arm band between their upper and lower edges.

23. The swing training device of claim 18 wherein each arm has connected thereto a glider, the glider being slidably engaged to the corresponding rail for the arm band.

24. The swing training device of claim 18 wherein the glider includes means to facilitate movement of the gliders along the rails.

25. The swing training device of claim 18 wherein the torso fitting member includes an inwardly facing side and an outwardly facing side, the inwardly facing side including friction enhancing means to increase frictional engagement of the inwardly facing side against a surface.

26. A method for golf swing training for a trainee individual comprising:

providing a swing training device comprising a torso fitting member, a leading arm rail and a trailing arm rail, each of the leading arm rail and the trailing arm rail being formed of a substantially stiff material and secured to the torso fitting member, a leading arm band attached to and slidably moveable along the leading arm rail, and a trailing arm band attached to and slidably moveable along the trailing arm rail, the leading arm band and the trailing arm band each being formed of a strip of flexible material including upper and lower edges and ends, the leading arm band and the trailing arm band each having a releasable connector at their ends, the releasable connector having a closed configuration where the ends of the bands are secured to form a circle and an open configuration and a device for maintaining the ends of each arm band attached when the releasable connector is in the open position;

securing the torso fitting member about the trainee individual's torso;

securing the leading arm band about the trainee individual's leading arm using the releasable connector of the leading arm band;

securing the trailing arm band about the trainee individual's trailing arm using the releasable connector of the trailing arm band; and permitting the trainee individual to perform a golf swing.

27. The method for golf swing training as in claim 26 wherein a lock is positioned on at least a selected one of the leading arm rail or the trailing arm rail to limit the range of movement of the trainee individual's arm which is connected to the selected rail.

28. The method for golf swing training an in claim 26 wherein at least a selected one of the leading arm rail or the trailing arm rail is positioned on the torso fitting member.

* * * * *